US010302270B2

(12) United States Patent
Hiki

(10) Patent No.: US 10,302,270 B2
(45) Date of Patent: May 28, 2019

(54) VEHICLE LIGHTING APPARATUS

(71) Applicant: Stanley Electric Co., Ltd., Tokyo (JP)

(72) Inventor: Satoru Hiki, Yokohama (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 143 days.

(21) Appl. No.: 15/458,679

(22) Filed: Mar. 14, 2017

(65) Prior Publication Data

US 2017/0276311 A1 Sep. 28, 2017

(30) Foreign Application Priority Data

Mar. 25, 2016 (JP) ..... 2016-061933

(51) Int. Cl.

| | |
|---|---|
| ***F21S 8/00*** | (2006.01) |
| ***F21S 41/36*** | (2018.01) |
| ***F21S 41/25*** | (2018.01) |
| ***F21S 41/19*** | (2018.01) |
| ***F21S 41/141*** | (2018.01) |
| ***F21S 41/147*** | (2018.01) |
| ***F21S 41/20*** | (2018.01) |
| ***F21S 41/255*** | (2018.01) |
| ***F21S 41/32*** | (2018.01) |

(Continued)

(52) U.S. Cl.

CPC ..... *F21S 41/36* (2018.01); *F21S 41/141* (2018.01); *F21S 41/147* (2018.01); *F21S 41/19* (2018.01); *F21S 41/25* (2018.01); *F21S 41/255* (2018.01); *F21S 41/285* (2018.01); *F21S 41/321* (2018.01); *F21S 41/322* (2018.01); *F21S 41/43* (2018.01); *F21S 41/365* (2018.01); *F21Y 2115/10* (2016.08)

(58) Field of Classification Search

CPC ..... F21S 41/36; F21S 41/25; F21S 41/147; F21S 41/322; F21S 41/255; F21S 41/19; F21S 41/141; F21S 41/321; F21S 41/42; F21S 41/285

See application file for complete search history.

(56) References Cited

U.S. PATENT DOCUMENTS 8,545,073 B2 * 10/2013 Meyrenaud ..... F21S 41/147 362/545

FOREIGN PATENT DOCUMENTS

JP 5678777 B2 3/2015

* cited by examiner

*Primary Examiner* — Anabel Ton
(74) *Attorney, Agent, or Firm* — Kenealy Vaidya LLP

(57) ABSTRACT

A vehicle lighting apparatus includes: a light source; a reflector that reflects light emitted from the light source toward a vehicle travel direction; a light distribution control unit that controls light distribution of light reflected by the reflector; and a projection lens that projects the light of which the light distribution is controlled by the light distribution control unit toward the vehicle travel direction, wherein the light distribution control unit has a structure in which a plurality of reflection elements are provided to be aligned in a vehicle width direction, and wherein light that is incident on the projection lens from an upper direction of the plurality of reflection elements of the light reflected by the reflector forms a light distribution pattern that includes a cutoff line which is defined by an upper end of the plurality of reflection elements, and light that is incident on the plurality of reflection elements is reflected toward the projection lens to thereby form a complementary light distribution pattern that is different from the light distribution pattern.

10 Claims, 5 Drawing Sheets

(51) Int. Cl.

| | |
|---|---|
| ***F21S 41/43*** | (2018.01) |
| *F21Y 115/10* | (2016.01) |
| *F21S 41/365* | (2018.01) |

VEHICLE LIGHTING APPARATUS

CROSS-REFERENCE TO RELATED APPLICATION

Priority is claimed on Japanese Patent Application No. 2016-61933, filed on Mar. 25, 2016, the contents of which are incorporated herein by reference.

BACKGROUND

Field of the Invention

The present invention relates to a vehicle lighting apparatus.

Background

For example, a vehicle lighting apparatus such as a vehicle headlamp includes a light source, a reflector that reflects light emitted from the light source toward a vehicle travel direction, a shade that blocks (cuts) part of the light reflected by the reflector, and a projection lens that projects the light of which part is cut by the shade toward the vehicle travel direction. In such a vehicle lighting apparatus, a light source image that is defined by a front end of the shade is reversely projected by the projection lens, and thereby, a low beam light distribution pattern that has an upper end including a cutoff line is formed (for example, refer to Japanese Patent No. 5678777).

SUMMARY

Light that is cut by the shade of the light emitted from the light source is not projected toward the vehicle travel direction but is absorbed in the vehicle lighting apparatus. Therefore, the light that is cut by the shade is not used and becomes a loss.

An object of an aspect of the present invention is to provide a vehicle lighting apparatus capable of further enhancing a usage efficiency of light emitted from a light source.

(1) A vehicle lighting apparatus according to an aspect of the present invention includes: a light source; a reflector that reflects light emitted from the light source toward a vehicle travel direction; a light distribution control unit that controls light distribution of light reflected by the reflector; and a projection lens that projects the light of which the light distribution is controlled by the light distribution control unit toward the vehicle travel direction, wherein the light distribution control unit has a structure in which a plurality of reflection elements are provided to be aligned in a vehicle width direction, and wherein light that is incident on the projection lens from an upper direction of the plurality of reflection elements of the light reflected by the reflector forms a light distribution pattern that includes a cutoff line which is defined by an upper end of the plurality of reflection elements, and light that is incident on the plurality of reflection elements is reflected toward the projection lens to thereby form a complementary light distribution pattern that is different from the light distribution pattern.

(2) In the above-described vehicle lighting apparatus, the reflection element may include a first reflection surface and a second reflection surface, and wherein light that is incident on the first reflection surface may be reflected toward the second reflection surface, and then light that is incident on the second reflection surface may be reflected toward the projection lens.

(3) In the above-described vehicle lighting apparatus, the plurality of reflection elements may be a plurality of mirrors that are arranged in a slanted state with respect to an optical axis of the light emitted from the light source, wherein the plurality of mirrors may include a first mirror and a second mirror that are adjacent to each other, and wherein the first reflection surface may be formed of a slanted surface, which faces the second mirror, of the first mirror, and the second reflection surface may be formed of a slanted surface, which faces the first mirror, of the second mirror.

(4) In the above-described vehicle lighting apparatus, the plurality of reflection elements may be a plurality of prisms including an incidence surface, the first reflection surface, the second reflection surface, and an emission surface, and light that is incident on the incidence surface to enter an inside of the prism may be reflected by the first reflection surface and the second reflection surface and may be then emitted outside the prism from the emission surface.

(5) In the above-described vehicle lighting apparatus, the plurality of reflection elements may be arranged to be symmetrically aligned so as to interpose an optical axis of the light emitted from the light source.

(6) In the above-described vehicle lighting apparatus, the complementary light distribution pattern may be an overhead light distribution pattern that is formed above the cutoff line.

As described above, according to an aspect of the present invention, it is possible to provide a vehicle lighting apparatus capable of further enhancing a usage efficiency of light emitted from a light source.

DESCRIPTION OF THE EMBODIMENTS

Figure 1:
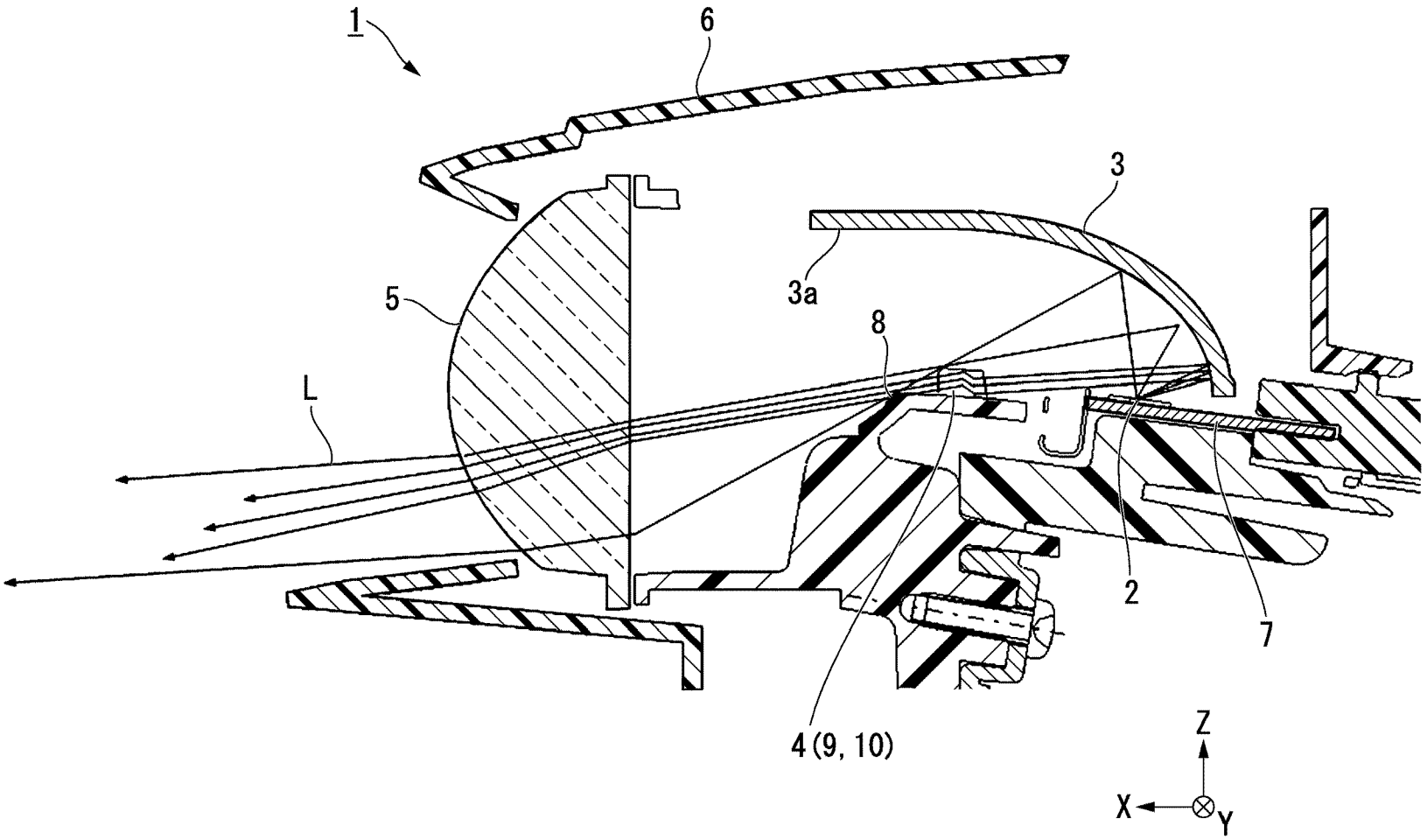
FIG. 1 is a cross-sectional view showing a configuration of a vehicle lighting apparatus according to an embodiment of the present invention.

Hereinafter, an embodiment of the present invention is described in detail with reference to the drawings.

In the drawings used in the following description, there may be a case in which, for ease of understanding the components, the components are shown using different dimension reduction scales depending on the component, and the dimension ratio of each component or the like is not always the same as an actual one.

As an embodiment of the present invention, for example, a vehicle lighting apparatus 1 shown in FIG. 1 is described. FIG. 1 is a cross-sectional view showing a configuration of the vehicle lighting apparatus 1. In the drawings described below, an XYZ orthogonal coordinate system is set in which an X-axis direction is represented as the front-to-rear direction of the vehicle lighting apparatus 1, a Y-axis direction is represented as the right-to-left direction of the vehicle lighting apparatus 1, and a Z-axis direction is represented as the vertical direction of the vehicle lighting apparatus 1.

The vehicle lighting apparatus 1 of the present embodiment forms, for example, a vehicle headlamp (headlight) as shown in FIG. 1. The vehicle lighting apparatus 1 includes a light source 2, a reflector 3, a light distribution control unit 4, and a projection lens 5. The vehicle lighting apparatus 1 has a configuration in which the light source 2, the reflector 3, the light distribution control unit 4, and the projection lens 5 are held on the inside of an extension 6.

The light source 2 is an LED module in which an LED is mounted in a package. An LED that emits white light (hereinafter, simply referred to as "light") L is used for the LED module. A high-output-type LED for vehicle illumination is used for the LED. The light source 2 is mounted on a circuit board 7 and radially emits the light L emitted by the LED module toward the upward direction (+Z direction).

A light-emitting device such as a laser diode (LD) other than the above-described LED can be used for the light source 12. The type of the light source 2 is not specifically limited. A light source other than the above-described light-emitting device may be used. The number of the light source 2 is not limited to one. The number of the light source 2 may be two or more.

The reflector 3 is formed of, for example, a reflection member such as an aluminum die-cast. The reflector 3 is positioned above the light source 2 and is formed to be curved so as to form a parabola of which the focal point is the center (light emission point) of the light source 2 from a base end (rear end) part toward a tip end (front end) part of the reflector 3 in a cross-section along the front-to-rear direction (X-axis direction) of the vehicle. In the reflector 3, a surface (inner surface), which faces the light source 2, of the reflector 3 is a reflection surface 3*a*. The reflector 3 reflects the light L emitted from the light source 2 toward a vehicle travel direction (+X-axis direction) by the reflection surface 3*a*.

Figure 2A:
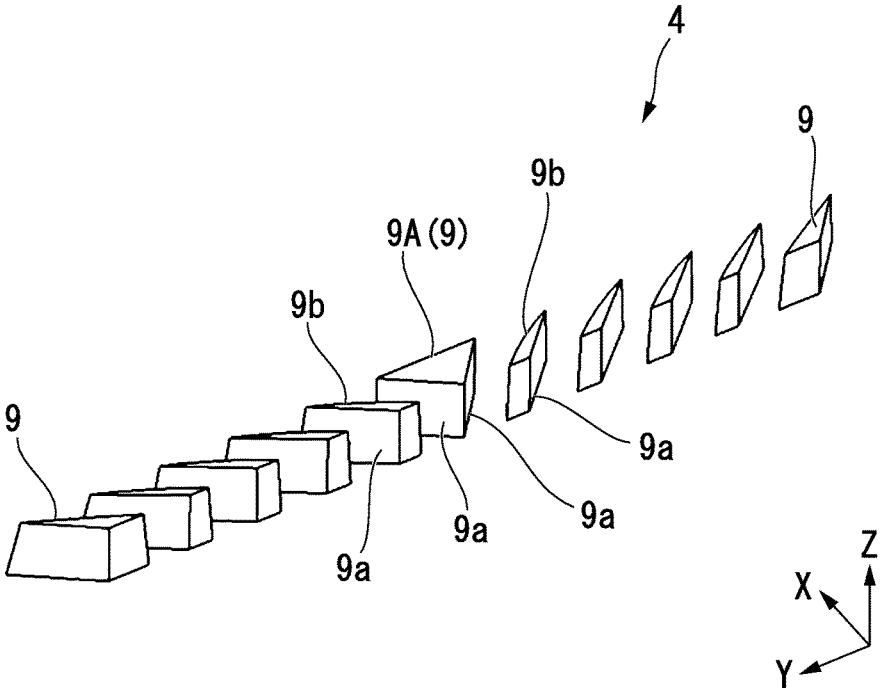
FIG. 2A shows a configuration example of a light distribution control unit included in the vehicle lighting apparatus shown in FIG. 1 and is a perspective view showing an appearance of the light distribution control unit.
Figure 2B:
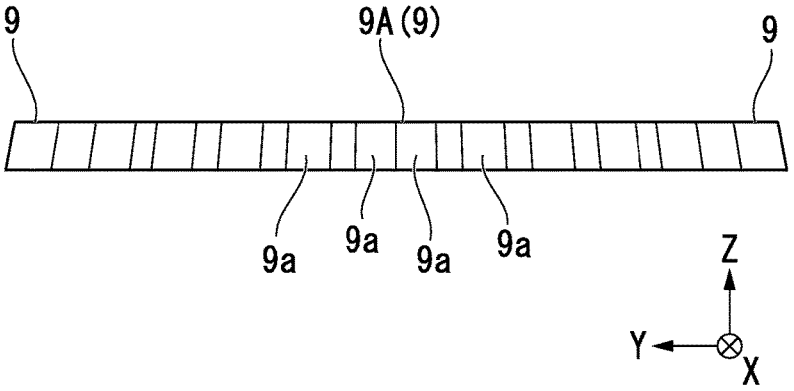
FIG. 2B shows a configuration example of the light distribution control unit included in the vehicle lighting apparatus shown in FIG. 1 and is a front view seen from a light source side of the light distribution control unit.

The light distribution control unit 4 controls light distribution of the light L reflected by the reflector 3. The light distribution control unit 4 has, for example, a configuration as shown in FIGS. 2A, 2B. FIG. 2A is a perspective view showing an appearance of the light distribution control unit 4. FIG. 2B is a front view seen from the light source 2 side of the light distribution control unit 4.

Specifically, the light distribution control unit 4 has a configuration in which a plurality of mirrors 9 are provided to be aligned in a vehicle width direction (Y-axis direction) on a shade 8 as shown in FIG. 1 and FIGS. 2A, 2B.

The shade 8 is a member (light shield member) that blocks (cuts) part of the light L reflected by the reflector 3. The shade 8 is arranged at a more front position than the light source 2 such that light that is incident on a lower part of the projection lens 5 is cut of the light L reflected by the reflector 3.

The plurality of mirrors 9 are reflection elements that include a first reflection surface 9*a* and a second reflection surface 9*b*. For example, a reflection member such as aluminum can be used for the plurality of mirrors 9. The configuration of the plurality of mirrors 9 is not limited to a configuration in which the plurality of mirrors 9 are attached to the shade 8. The plurality of mirrors 9 can be also formed integrally with the shade 8.

The plurality of mirrors 9 are arranged in a slanted state in the same direction with respect to an optical axis of the light L emitted from the light source 2. The plurality of mirrors 9 are arranged to be symmetrically aligned so as to interpose the optical axis of the light L emitted from the light source 2.

A mirror 9A, which is positioned at the center of the light distribution control unit 4, of the plurality of mirrors 9 has a configuration in which the first reflection surfaces 9*a* that are slanted in the opposite direction to each other are integrated, and thereby, the second reflection surface 9*b* is omitted. The configuration of the mirror 9A is not limited to such an integrated configuration, and the mirror 9A may be formed of two mirrors 9 that are slanted in the opposite direction to each other similarly to other mirrors 9.

With respect to one mirror 9 (a first mirror) and the other mirror 9 (a second mirror) that are adjacent to each other, the first reflection surface 9*a* is formed of a slanted surface, which faces the other mirror 9 (the second mirror), of one mirror 9 (the first mirror), and the second reflection surface 9*b* is formed of a slanted surface, which faces one mirror 9 (the first mirror), of the other mirror 9 (the second mirror).

In the light distribution control unit 4, light L that is incident on the first reflection surface 9*a* is reflected toward the second reflection surface 9*b*, and then the light L that is incident on the second reflection surface 9*b* is reflected toward the projection lens 5.

The projection lens 5 is a convex lens arranged at a more front position than the light distribution control unit 4. The projection lens 5 enlarges and projects light L of which the light distribution is controlled by the light distribution control unit 4 toward the vehicle travel direction (+X-axis direction).

Figure 3A:
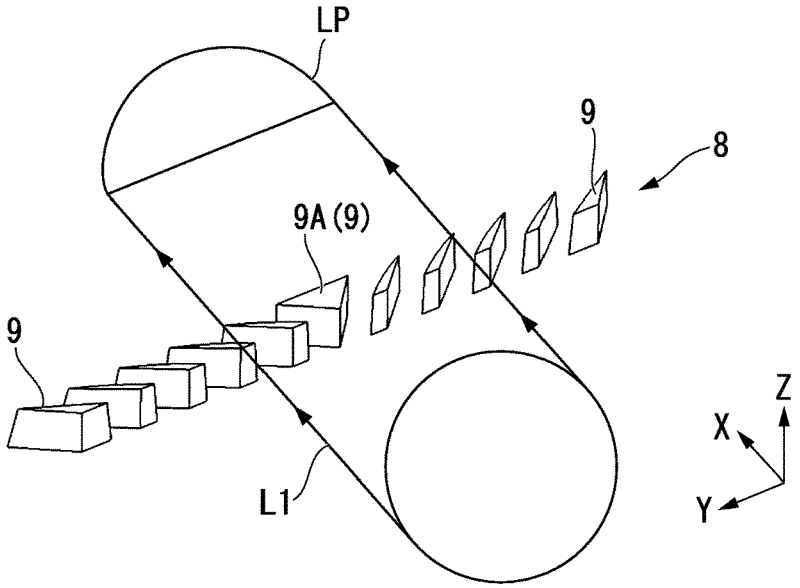
FIG. 3A shows a light distribution control according to the light distribution control unit shown in FIG. 2A and FIG. 2B and is a perspective view showing a light distribution pattern that includes a cutoff line which is defined by the light distribution control unit.
Figure 3B:
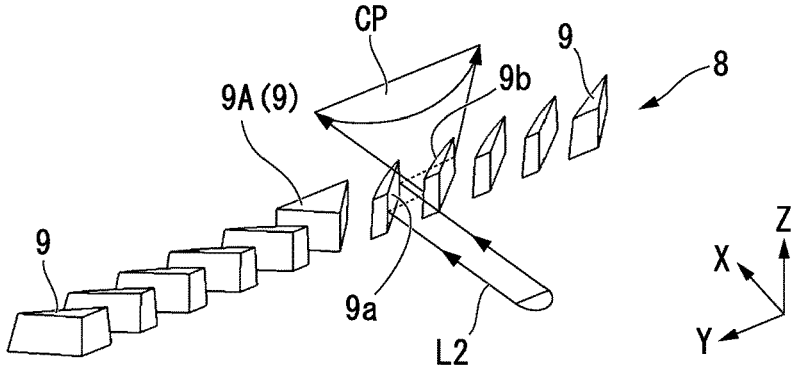
FIG. 3B shows a light distribution control according to the light distribution control unit shown in FIG. 2A and FIG. 2B and is a perspective view showing a light distribution pattern and an optical path of light that is incident on a plurality of mirrors.
Figure 3C:
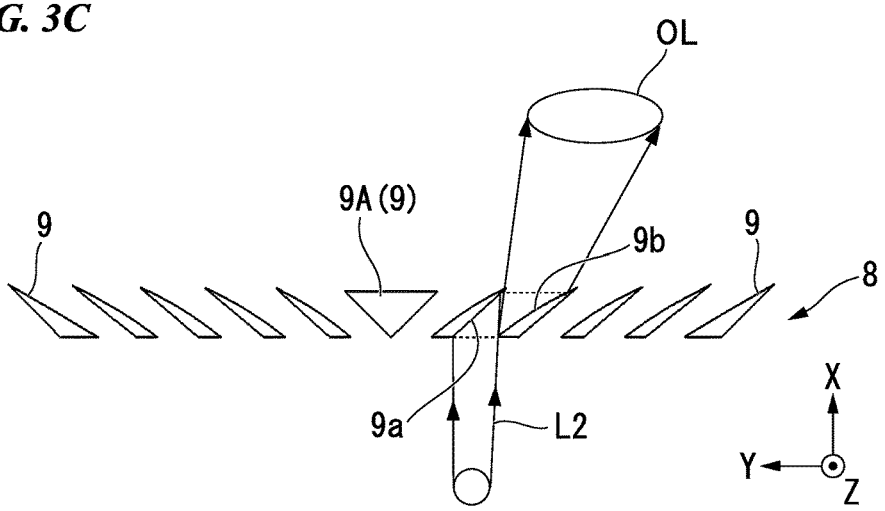
FIG. 3C shows a light distribution control according to the light distribution control unit shown in FIG. 2A and FIG. 2B and is a top view showing a light distribution pattern and an optical path of light that is incident on the plurality of mirrors.

The light distribution control according to the light distribution control unit 4 of the vehicle lighting apparatus 1 having the above-described configuration is described with reference to FIGS. 3A to 3C. FIG. 3A is a perspective view showing a low beam light distribution pattern LP that includes a cutoff line which is defined by the plurality of mirrors 9. FIG. 3B is a perspective view showing an example of a complementary light distribution pattern CP according to light L2 that is incident on the plurality of mirrors 9. FIG. 3C is a top view showing an overhead (OH)

light distribution pattern OP according to the light L2 that is incident on the plurality of mirrors 9.

In the vehicle lighting apparatus 1 of the present embodiment, part (not shown) of the light L reflected by the reflector 3 is blocked (cut) by the shade 8. As shown in FIG. 3A, light L1 that is incident on the projection lens 5 from an upper direction of the plurality of mirrors 9 forms a low beam light distribution pattern LP that includes a cutoff line which is defined by an upper end of the plurality of mirrors 9.

That is, in the vehicle lighting apparatus 1 of the present embodiment, a light source image that is defined by the upper end of the plurality of mirrors 9 is reversely projected by the projection lens 5, and thereby, the low beam light distribution pattern LP that has an upper end including the cutoff line is foil led.

On the other hand, as shown in FIG. 3B, the light L2 that is incident on the plurality of mirrors 9 is reflected toward the second reflection surface 9*b* by the first reflection surface 9*a* of each mirror 9 and is then reflected toward the projection lens 5 by the second reflection surface 9*b* of each mirror 9. The spot size of the light L2 after being emitted from the mirror 9 is greater than that before being incident on the mirror 9.

Thereby, the complementary light distribution pattern CP for complementing the low beam light distribution pattern LP can be formed. That is, the complementary light distribution pattern CP is formed by utilizing part of the light that is cut by the shade in the related art.

In the vehicle lighting apparatus 1 of the present embodiment, by adjusting each of the shape of each mirror 9, the angle of the first reflection surface 9*a* and the second reflection surface 9*b* described above, and the like, the light distribution (shape, luminosity distribution, and the like) of the complementary light distribution pattern CP can be easily controlled.

Accordingly, in the vehicle lighting apparatus 1 of the present embodiment, by superposing the light L2 that is incident on the plurality of mirrors 9, that is, the light L2 that forms the complementary light distribution pattern CP on the light L1 that forms the low beam light distribution pattern LP, it is possible to allow the low beam light distribution pattern LP to have a further optimum shape, luminosity distribution, and the like.

In the vehicle lighting apparatus 1 of the present embodiment, as shown in FIG. 3C, the OH light distribution pattern OP can also be formed above the cutoff line according to the light L2 that is incident on the plurality of mirrors 9. In this case, by adjusting each of the shape of each mirror 9, the angle of the first reflection surface 9*a* and the second reflection surface 9*b*, and the like, the light distribution (shape, luminosity distribution, and the like) of the OH light distribution pattern OP can be easily controlled.

As described above, in the vehicle lighting apparatus 1 of the present embodiment, by utilizing part of the light that is cut by the shade in the related art, it is possible to further enhance a usage efficiency of the light L emitted from the light source 2. In the vehicle lighting apparatus 1 of the present embodiment, it is possible to easily control the light distribution of the light emitted by the vehicle lighting apparatus 1 according to each mirror 9 that forms the light distribution control unit 4.

The present invention is not limited to the above-described embodiment, and a variety of changes can be made without departing from the scope of the invention.

Figure 4A:
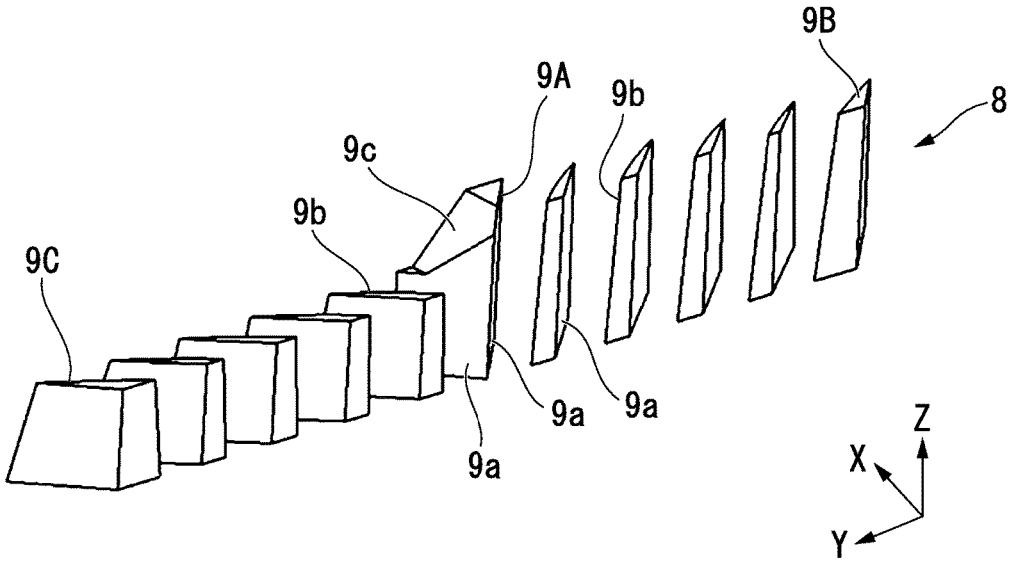
FIG. 4A shows a modified example of the plurality of mirrors and is a perspective view showing an appearance of a plurality of mirrors.
Figure 4B:
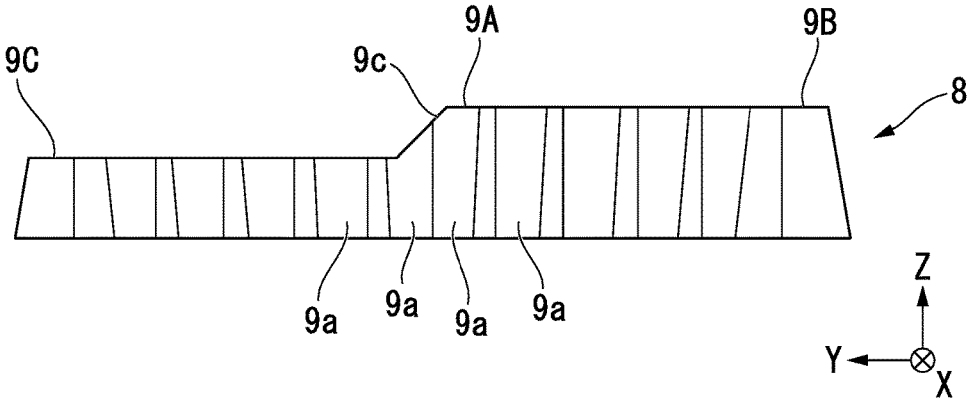
FIG. 4B shows the modified example of the plurality of mirrors and is a front view seen from a light source side of the plurality of mirrors.

Specifically, the vehicle lighting apparatus 1 of the present embodiment may be formed of, for example, a plurality of mirrors 9A, 9B, 9C as shown in FIGS. 4A, 4B in order to form the above-described cutoff line in a step shape. FIG. 4A is a perspective view showing an appearance of the plurality of mirrors 9A, 9B, 9C. FIG. 4B is a front view seen from the light source 2 side of the plurality of mirrors 9A, 9B, 9C.

In the configuration shown in FIGS. 4A, 4B, the mirrors 9B on the right side and the mirrors 9C on the left side that interpose the mirror 9A positioned at the center of the plurality of mirrors 9A, 9B, 9C have a height different from each other. A step surface 9*c* that is matched to the height of the mirrors 9B on the right side and the height of the mirrors 9C on the left side is provided on the upper end of the mirror 9A positioned at the center.

In the vehicle lighting apparatus 1, a light source image that is defined by the upper end of the plurality of mirrors 9A, 9B, 9C is reversely projected by the projection lens 5, and thereby, the above-described cutoff line can be formed in a step shape.

Figure 5A:
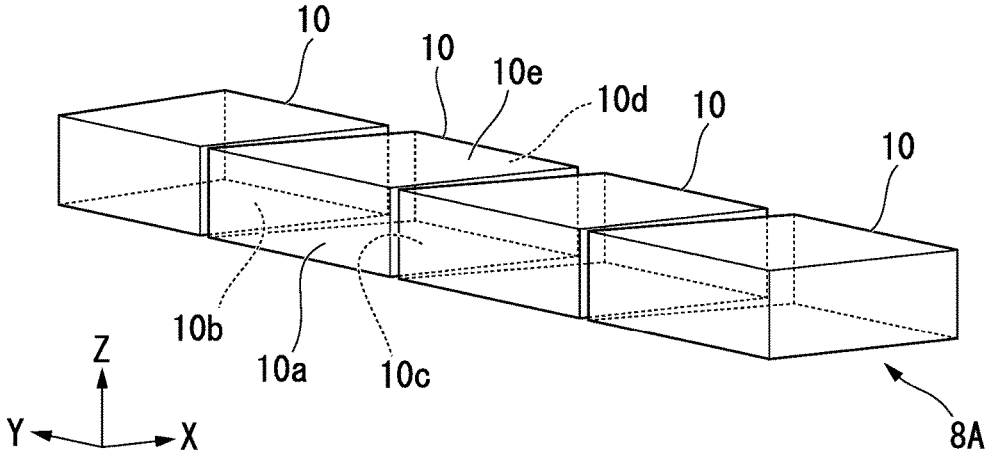
FIG. 5A shows another configuration example of the light distribution control unit included in the vehicle lighting apparatus shown in FIG. 1 and is a perspective view showing an appearance of the light distribution control unit.
Figure 5B:
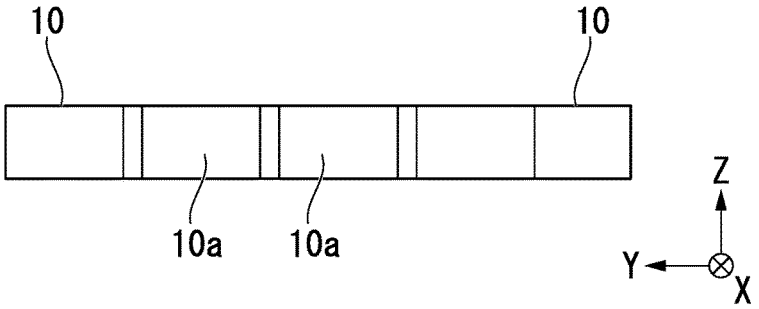
FIG. 5B shows another configuration example of the light distribution control unit included in the vehicle lighting apparatus shown in FIG. 1 and is a front view seen from a light source side of the light distribution control unit.
Figure 5C:
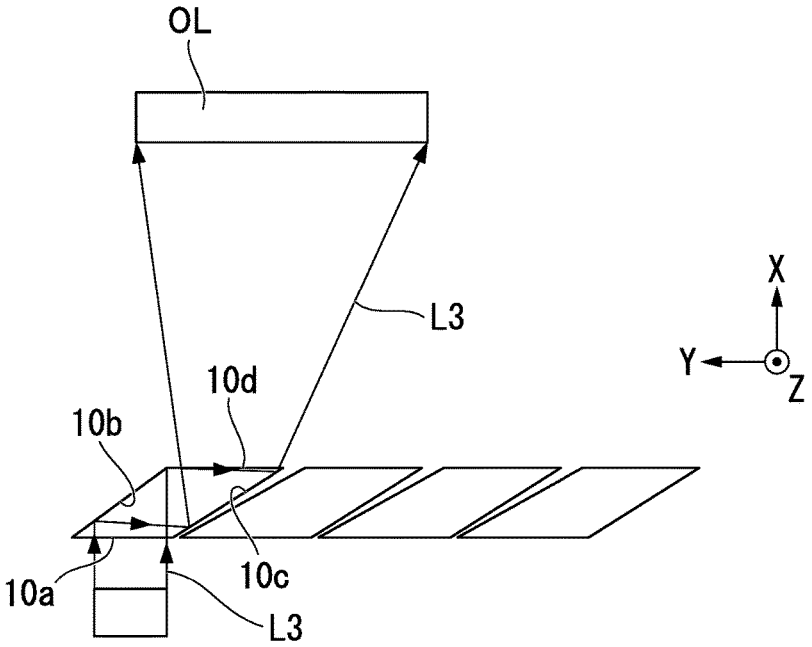
FIG. 5C shows another configuration example of the light distribution control unit included in the vehicle lighting apparatus shown in FIG. 1 and is a perspective view showing a light distribution control of the light distribution control unit.

The vehicle lighting apparatus 1 of the present embodiment may have, for example, a configuration that includes a light distribution control unit 4A as shown in FIGS. 5A to 5C. FIG. 5A is a perspective view showing an appearance of the light distribution control unit 4A. FIG. 5B is a front view seen from the light source 2 side of the light distribution control unit 4A. FIG. 5C is a perspective view showing a light distribution control according to the light distribution control unit 4A. In the following description, explanation of a part similar to that of the light distribution control unit 4 described above is omitted, and the part is given by the same reference numeral in the drawings.

As shown in FIGS. 5A, 5B, the light distribution control unit 4A has a configuration in which a prism 10 is used in place of the mirror 9 described above. That is, the light distribution control unit 4A has a configuration in which a plurality of prisms 10 are provided to be aligned in the vehicle width direction (Y-axis direction) on the shade 8.

The plurality of prisms 10 are reflection elements that include an incidence surface 10*a*, a first reflection surface 10*b*, a second reflection surface 10*c*, and an emission surface 10*d*. A material that has a higher refractive index than air which is, for example a transparent plastic such as polycarbonate and acrylic, glass, or the like can be used for the prism 10.

The incidence surface 10*a* and the emission surface 10*d* are arranged in parallel with each other in the vehicle width direction (Y-axis direction). The first reflection surface 10*b* and the second reflection surface 10*c* are arranged in a slanted state in the same direction with respect to the optical axis of the light L emitted from the light source 2. The plurality of prisms 10 are arranged to be symmetrically aligned so as to interpose the optical axis of the light L emitted from the light source 2 similarly to the plurality of mirrors 9 described above (not shown in the drawings).

As shown in FIG. 5C, in the light distribution control unit 4A, light L3 that is incident on the incidence surface 10*a* to enter the inside of the prism 10 is reflected by the first reflection surface 10*b* and the second reflection surface 10*c* and is then emitted outside the prism 10 from the emission surface 10*d*. The spot size of the light L3 after being emitted from the prism 10 is greater than that before being incident on the prism 10.

In the case of this configuration, similarly to the plurality of mirrors 9 described above, according to the light L1 that is incident on the projection lens 5 from the upper direction of the plurality of prisms 10, it is possible to form a low beam light distribution pattern LP that includes a cutoff line which is defined by an upper end of the plurality of prisms

10. Further, similarly to the plurality of mirrors 9 described above, according to the light L3 that is incident on the plurality of prisms 10, it is possible to form the complementary light distribution pattern CP or the OH light distribution pattern OP described above.

The configuration of the first reflection surface 10*b* and the second reflection surface 10*c* is not limited to a configuration in which light is totally reflected in the prism 10. A configuration may be used in which a reflection film (for example, an aluminum evaporated film and the like) is provided on the reflection surfaces 10*b*, 10*c* to thereby reflect the light L by the reflection film. A light shielding film or the like may be provided on an upper surface 10*e* of the prism 10.

What is claimed is:

1. A vehicle lighting apparatus, comprising:

a light source;

a reflector that reflects light emitted from the light source toward a vehicle travel direction;

a light distribution control unit that controls light distribution of light reflected by the reflector; and a projection lens that projects the light of which the light distribution is controlled by the light distribution control unit toward the vehicle travel direction, wherein the light distribution control unit has a structure in which a plurality of reflection elements are provided to be aligned in a vehicle width direction, wherein light that is incident on the projection lens from an upper direction of the plurality of reflection elements of the light reflected by the reflector forms a light distribution pattern that includes a cutoff line which is defined by an upper end of the plurality of reflection elements, and light that is incident on the plurality of reflection elements is reflected toward the projection lens to thereby form a complementary light distribution pattern that is different from the light distribution pattern, wherein at least one of the plurality of reflection elements includes a first reflection surface and a second reflection surface, and wherein light that is incident on the first reflection surface is reflected toward the second reflection surface, and then light that is incident on the second reflection surface is reflected toward the projection lens.

2. The vehicle lighting apparatus according to claim 1, wherein the plurality of reflection elements are a plurality of mirrors that are arranged in a slanted state with respect to an optical axis of the light emitted from the light source, wherein the plurality of mirrors include a first mirror and a second mirror that are adjacent to each other, and wherein the first reflection surface is formed of a slanted surface, which faces the second mirror, of the first mirror, and the second reflection surface is formed of a slanted surface, which faces the first mirror, of the second mirror.

3. The vehicle lighting apparatus according to claim 1, wherein the plurality of reflection elements are a plurality of prisms including an incidence surface, the first reflection surface, the second reflection surface, and an emission surface, and wherein light that is incident on the incidence surface to enter an inside of the prism is reflected by the first reflection surface and the second reflection surface and is then emitted outside the prism from the emission surface.

4. The vehicle lighting apparatus according to claim 2, wherein the plurality of reflection elements are arranged to be symmetrically aligned so as to interpose an optical axis of the light emitted from the light source.

5. The vehicle lighting apparatus according to claim 3, wherein the plurality of reflection elements are arranged to be symmetrically aligned so as to interpose an optical axis of the light emitted from the light source.

6. The vehicle lighting apparatus according to claim 1, wherein the complementary light distribution pattern is an overhead light distribution pattern that is formed above the cutoff line.

7. The vehicle lighting apparatus according to claim 2, wherein the complementary light distribution pattern is an overhead light distribution pattern that is formed above the cutoff line.

8. The vehicle lighting apparatus according to claim 3, wherein the complementary light distribution pattern is an overhead light distribution pattern that is formed above the cutoff line.

9. The vehicle lighting apparatus according to claim 4, wherein the complementary light distribution pattern is an overhead light distribution pattern that is formed above the cutoff line.

10. The vehicle lighting apparatus according to claim 5, wherein the complementary light distribution pattern is an overhead light distribution pattern that is formed above the cutoff line.

* * * * *